US011557845B2

(12) United States Patent
Spilker et al.

(10) Patent No.: US 11,557,845 B2
(45) Date of Patent: Jan. 17, 2023

(54) MODULAR PLUG-IN CONNECTOR SYSTEM

(71) Applicant: HARTING Electric Stiftung & Co. KG, Espelkamp (DE)

(72) Inventors: Nicole Spilker, Lübbecke (DE); Heiko Herbrechtsmeier, Bünde (DE)

(73) Assignee: HARTING Electric Stiftung & Co. KG, Espelkamp (DE)

( * ) Notice: Subject to any disclaimer, the term of this patent is extended or adjusted under 35 U.S.C. 154(b) by 212 days.

(21) Appl. No.: 17/259,953

(22) PCT Filed: Jul. 17, 2019

(86) PCT No.: PCT/DE2019/100659
§ 371 (c)(1),
(2) Date: Jan. 13, 2021

(87) PCT Pub. No.: WO2020/025087
PCT Pub. Date: Feb. 6, 2020

(65) Prior Publication Data

US 2021/0313714 A1 Oct. 7, 2021

(30) Foreign Application Priority Data

Aug. 2, 2018 (DE) ..... 10 2018 118 774.2

(51) Int. Cl.
*H01R 13/506* (2006.01)
*H01R 9/05* (2006.01)
*H01R 13/627* (2006.01)

(52) U.S. Cl.
CPC ..... *H01R 9/0518* (2013.01); *H01R 13/506* (2013.01); *H01R 13/6272* (2013.01)

(58) Field of Classification Search
CPC H01R 9/0518; H01R 13/506; H01R 13/6272; H01R 13/6273; H01R 13/5221; H01R 13/465
See application file for complete search history.

(56) References Cited

U.S. PATENT DOCUMENTS 1,672,521 A 6/1928 Goldrick
4,010,538 A 3/1977 OKeefe et al.
(Continued)

FOREIGN PATENT DOCUMENTS

CN 101123334 A 2/2008
CN 101299500 A 11/2008
(Continued)

OTHER PUBLICATIONS

Delock, Datasheet "ATX Kabel 24-polig Stecker zu 20-polig Buchse," unknown publication date, retrieved from www.delock.de/files/9300.download&usg=AOvVaw0eNlacfZzsR79Y1NUpsiQ1 on Oct. 29, 2021.

*Primary Examiner* — Tho D Ta
(74) *Attorney, Agent, or Firm* — Smartpat PLC

(57) ABSTRACT

The invention relates to a plug-in connector, substantially consisting of an insulating body and at least one contact element which is mounted directly in the insulating body, wherein the insulating body directly forms the plug-in connector housing of the plug-in connector. The plug-in connector is of particularly simple construction and can therefore be manufactured quickly. In addition, the plug-in connector is of very robust design and suitable for industrial use, in particular in harsh environments.

18 Claims, 6 Drawing Sheets

(56) References Cited

U.S. PATENT DOCUMENTS

| | | | | |
|---|---|---|---|---|
| 4,776,813 | A * | 10/1988 | Wilson | H01R 13/5208 439/587 |
| 5,073,127 | A | 12/1991 | Daly et al. | |
| 5,299,949 | A * | 4/1994 | Fortin | H01R 13/5205 439/589 |
| 5,618,198 | A * | 4/1997 | Sato | H01R 13/5208 439/279 |
| 7,059,918 | B2 | 6/2006 | Matsumoto et al. | |
| 9,831,593 | B1 * | 11/2017 | Tartaglia | H01R 13/465 |
| 2001/0044231 | A1 | 11/2001 | Bogdan et al. | |
| 2004/0235321 | A1 | 11/2004 | Mizumura et al. | |
| 2004/0235364 | A1 | 11/2004 | Matsumoto et al. | |
| 2008/0003876 | A1 | 1/2008 | Fukaya et al. | |
| 2011/0117770 | A1 | 5/2011 | Lindkamp | |
| 2013/0288516 | A1 * | 10/2013 | Chang | H01R 13/465 439/488 |
| 2014/0302694 | A1 | 10/2014 | Qiao et al. | |
| 2014/0370731 | A1 | 12/2014 | Meier et al. | |
| 2015/0318640 | A1 * | 11/2015 | Gibeau | H01R 13/641 439/489 |
| 2016/0240957 | A1 * | 8/2016 | Ludwig | H01R 13/502 |
| 2017/0149177 | A1 * | 5/2017 | Gzybowski | H01R 13/642 |
| 2017/0229813 | A1 * | 8/2017 | Exenberger | H01R 13/6295 |
| 2018/0241147 | A1 | 8/2018 | Loetkemann et al. | |
| 2018/0323549 | A1 | 11/2018 | Vogel et al. | |

FOREIGN PATENT DOCUMENTS

| | | | | |
|---|---|---|---|---|
| CN | 206293670 | U | 6/2017 | |
| CN | 107658629 | A * | 2/2018 | H01R 13/4364 |
| DE | 29823003 | U1 | 4/2000 | |
| DE | 19953592 | A1 | 8/2000 | |
| DE | 202008009894 | U1 | 9/2008 | |
| DE | 212012000216 | U1 | 7/2014 | |
| DE | 102015113786 | A1 | 2/2017 | |
| DE | 102017011421 | | 6/2019 | |
| EP | 0424699 | B1 | 6/1994 | |
| EP | 0945929 | B1 | 5/2003 | |
| EP | 1971000 | A2 | 9/2008 | |
| EP | 1873871 | B1 | 3/2011 | |
| EP | 3096413 | A1 | 11/2016 | |
| GB | 1537061 | A | 12/1978 | |
| WO | 2004105197 | A1 | 12/2004 | |

* cited by examiner

MODULAR PLUG-IN CONNECTOR SYSTEM

TECHNICAL FIELD

The disclosure relates to a plug-in connector, and more specifically to a plug-in connector for use in an industrial environment and in particular in a harsh industrial environment.

BACKGROUND

The publication EP 0 945 929 A2 discloses a plug-in connector having a rectangular cross-section for use in an industrial environment. The plug-in connector demonstrates an insulating body in which the contact elements are arranged using insulation displacement connection technology. The individual conductors of a connected cable are arranged in one contact piece. As the contact piece and the insulating body are joined together, the individual conductors are contacted by the associated contact elements in an electrically conductive manner. The insulating body that is joined to the contact piece is surrounded by a metal plug-in connector casing.

The plug-in connector disclosed in EP 0 945 929 A2 has proven its worth. However, owing to its multiple component parts, it necessitates high production costs and assembly costs. In addition, the parts require a large amount of installation space in the plug-in connector casing and this makes the overall plug-in connector extremely large and as a consequence limits its field of application.

The publication U.S. Pat. No. 1,672,521 A discloses a plug-in connector having a casing that is manufactured from two parts that are screwed together. The two parts each have two receiving devices for respectively fixing a contact element.

The publication GB 1 537 061 A discloses a plug-in connector having a plug-in connector casing that is injection molded onto a cable. Contact elements that are likewise arranged in the plug-in connector casing are arranged on the individual conductors of the cable.

The publication EP 0 424 699 A2 discloses a casing feed-through having an insulating body which has a cable passing through it.

The publication US 2004/0235321 A1 discloses two plug-in connectors which can be plugged together and mutually matching contact elements are held in the casing of each plug-in connector.

The publication DE 10 2015 113 786 A1 discloses a plug-in connector which has a plug-in connector casing having a locking bracket, an insulating body which is arranged in the plug-in connector casing and an electrical contact which is arranged in the insulating body.

There is generally a need in the industrial environment to make the best possible use of the available space, i.e. to accommodate as many technical components as possible in the limited space. A compact as possible installation space is accordingly required for such industrial plug-in connectors. A wide functionality spectrum is required simultaneously. The plug-in connectors must fulfill the most varied tasks.

During the priority application regarding the current application, the German Patent and Trademark Office has researched the following prior art: U.S. Pat. No. 1,672,521 A, GB 1 537 061 A, EP 0 424 699 A2, DE 10 2015 113 786 A1, US 2004/0235321 A1.

SUMMARY

The object of the disclosure is to design a compact as possible plug-in connector for harsh industrial environments and simultaneously to provide a wide breadth of functionality.

The object is achieved by the plug-in connector as described and claimed.

The plug-in connector can be produced is a particularly cost-effective manner owning to its modularity and the use of identical components in different design variants.

It is possible to provide different functionalities by means of simply exchanging only individual components.

The plug-in connector comprises an insulating body and at least one contact element that is attached or fixed directly in the insulating body. Generally, the plug-in connector has multiple contact elements that are all attached or fixed in the insulating body. The insulating body is configured in such a manner that it simultaneously forms the plug-in connector casing of the plug-in connector. As a consequence, the insulating body or the plug-in connector casing is configured outwardly in a corresponding robust and aesthetic manner.

The insulating body has a rectangular cross-section and is essentially in the shape of a cuboid. The outer surfaces are essentially smooth. Only the necessary function elements that for example render it possible to lock the plug-in connector with a mating plug-in connector are arranged or formed as one on the outer surfaces.

The terms 'plug-in connector' and 'mating plug-in connector' are used in part synonymously in this application. A mating plug-in connector describes merely a plug-in connector that is configured in such a manner that it can be plugged together with a matching plug-in connector.

It is preferred that the insulating body has an attachment tab or an attachment tongue for reversibly attaching to a mating plug-in connector. In this case, the mating plug-in connector can be constructed in a comparable manner to the plug-in connector and can have essentially the same features as the plug-in connector. A common feature can be that also in the case of the mating plug-in connector the insulating body forms the plug-in connector casing.

It is preferred that the plug-in connector has an attachment casing for attaching to an electrical device. In this case, the plug-in connector forms a so-called device socket on the electrical device. The attachment casing can be embodied in a straight manner but also in a bent manner, depending upon the construction and geometry of the device. As a consequence, the procedure of providing a plug-in connection with a plug-in connector that is to be connected thereto is more comfortable. Even if in this case the term 'device socket' is used, both insulating bodies having socket contacts and also insulating bodies having pin contacts fit into such an attachment casing.

Alternatively, the plug-in connector has a strain relief element so as to provide strain relief for multiple individual conductors, which are connected to the plug-in connector, or a connected cable that in turn can comprise multiple individual conductors running through an outer cable sheath. Such a plug-in connector offers strain relief protection for the conductors and/or for the cable and is often used in environments, for example within a switch cabinet or a device, in which it is not necessary to provide particular protection against media, such as for example water. Such a plug-in connector can be appropriately sealed by means of a seal that is mentioned below and has through-going openings, also called a single-wire sealing seal.

Alternatively, the plug-in connector has a cable casing for fixing and providing strain relief for a connected cable. In comparison to the simply constructed strain relief element, the cable casing offers in addition to the strain relief function also further improved sealing properties with the result that a plug-in connector that is configured in this manner is leakage-tight with respect to media such as water.

It is preferred that a bearing pin is formed as one in each case on two opposite-lying side faces of the insulating body. A locking bracket that has a U-shaped cross-section can be pivotably mounted on the bearing pin by way of lateral bearing receptacles of the locking bracket. The bearing pins advantageously each have a cylindrical basic shape with a prism-shaped contour formed thereon. It is preferred that the prism-shaped contour has a triangular cross section.

In a particularly advantageously embodiment of the plug-in connector, the locking bracket has in the region of each of its bearing receptacles an elevation that faces the plug-in connector casing. In the locked state, the elevation of the locking apparatus bears against the contour of the bearing pin. In the unlocked state, the locking apparatus is widened during the locking process by virtue of the cooperation between the elevation and the contour. The locking apparatus is also initially widened by means of the contour during the unlocking procedure as it is pivoted downward. The locking procedure and the unlocking procedure can thus be performed in each case in a manner in which the wear is low. As a consequence, the insulating body is not damaged or scratched by the locking bracket, as a result of which it can continue to provide its casing function.

It is preferred that the plug-in connector has a seal that has through-going openings for the contact elements and/or the conductors connected thereto. The number of through-going openings corresponds to the number of contact elements of the plug-in connectors. The seal is preferably arranged in the insulating body. As a consequence, the plug-in connector can achieve a particularly high degree of tightness.

In one advantageous embodiment of the invention, the plug-in connector has contact inserts in which at least one contact element is arranged. The contact carrier is attached in this case in the insulating body. Such a contract carrier is ideally used then if the contact elements are particularly large and/or heavy. It is preferred that contact elements of this type have a crimp connection or a screw connection for making electrical contact with a conductor. The contract carrier ensures that contact elements of this type sit securely in the insulating body.

In a particularly preferred embodiment of the invention, the plug-in connector has a shielding metal plate. The shielding metal plate is embodied in an essentially flat manner and is arranged within the insulating body parallel to the plug-in direction. On the connection side, the shielding metal plate can be electrically conductively connected to a shielding braid of the connected cable. It is preferred that the shielding metal plate has on the plug-in side two tabs that face in the plug-in direction and are arranged offset with respect to one another. If a plug-in connector that is facing the shielding metal plate is plugged together with a corresponding mating plug-in connector, the tabs of the plug-in connector each engage with the opposite-lying tabs of the mating plug-in connector with the result that the shielding function is reliably established.

In one advantageous variant of the invention, the plug-in connector has a shielding sleeve that is arranged within the insulating body. The shielding sleeve is used to electromagnetically shield the contact elements that are arranged in the plug-in connector. Such a plug-in connector transfers data or signals with particularly high signal integrity.

It is preferred that the plug-in connector has a least one identifying element. The identifying element can be clipped for example onto the outside of the insulating body, in other words can be reversibly fixed thereto. The identifying element is available in numerous colors and in each case has a color that is different from the insulating body. The insulating body is generally black. The identifying elements can be configured appropriately colored and in particular be provided with so-called signal colors. If multiple plug-in connectors are located on an electrical device, these can be easily distinguished from one another with the aid of differently colored identifying elements, which for example simplifies the maintenance of such an electrical device.

An exemplary embodiment of the invention is illustrated in the drawings and is explained in detail below.

DETAILED DESCRIPTION

Figure 1:
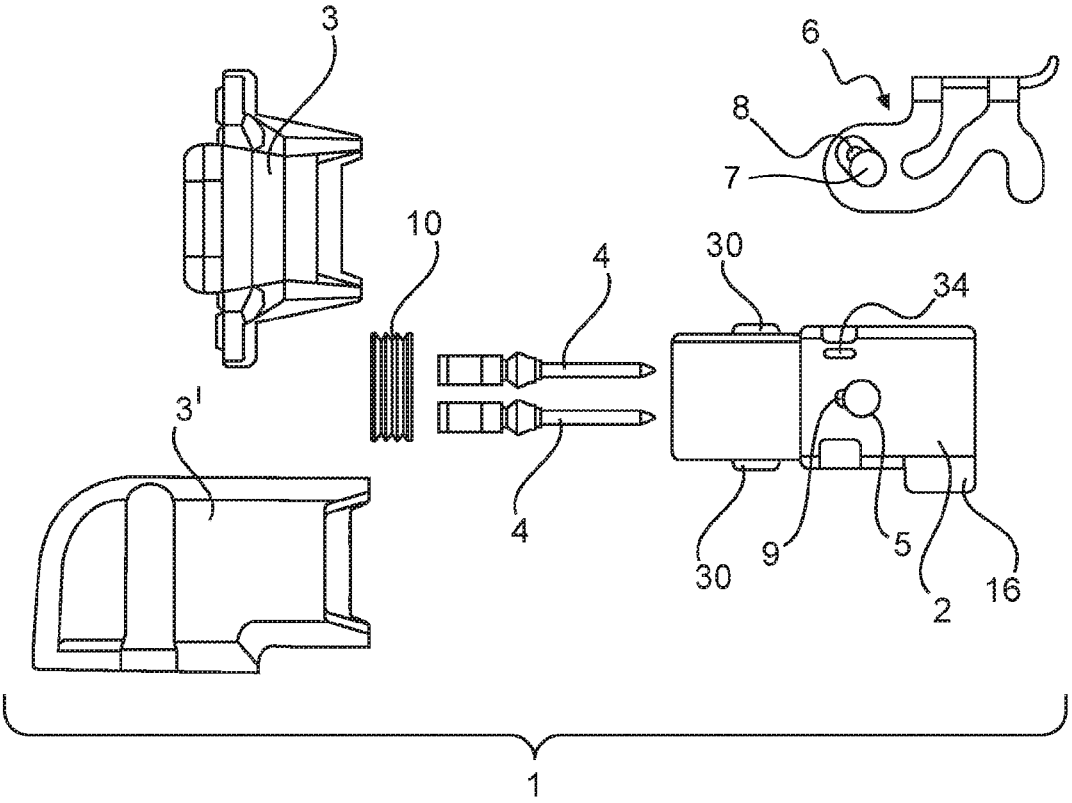
FIG. 1 illustrates an exploded drawing of a plug-in connector.
Figure 2:
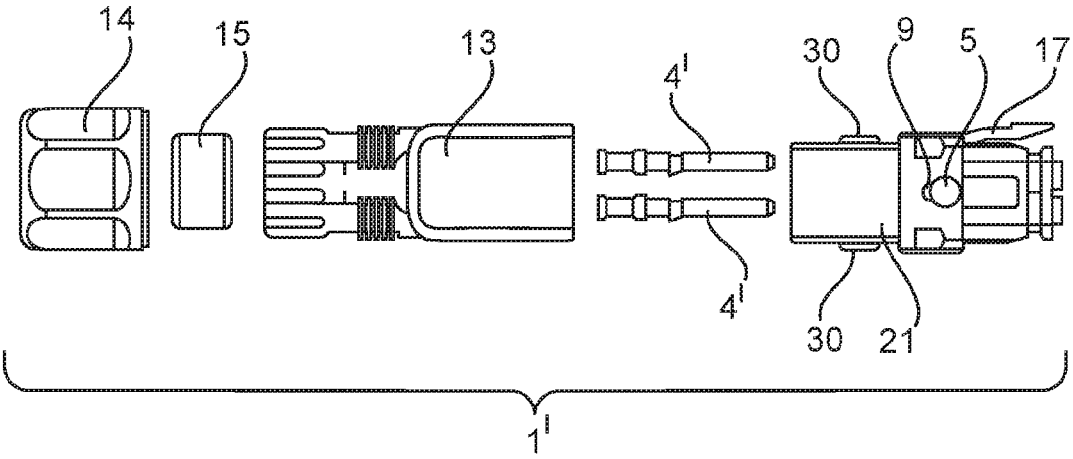
FIG. 2 illustrates an exploded drawing of a further plug-in connector.

The figures illustrate in part simplified schematic views. In part, identical reference numerals are used for similar but possibly not identical elements. Different views of similar elements may be scaled differently.

The invention relates to a plug-in connector 1, 1', 1", 1''', $\mathbf{1}^{IV}$, $\mathbf{1}^{V}$, $\mathbf{1}^{VI}$, $\mathbf{1}^{VII}$ that essentially comprises an insulating body 2, 2' and at least one contact element 4, 4', 4", 4''', $\mathbf{4}^{IV}$, $\mathbf{4}^{V}$, $\mathbf{4}^{VI}$, $\mathbf{4}^{VII}$ that is attached or held in the insulating body 2, 2', wherein the insulating body 2, 2' forms the plug-in connector casing of plug-in connector 1, 1', 1", 1''', $\mathbf{1}^{IV}$, $\mathbf{1}^{V}$, $\mathbf{1}^{VI}$, $\mathbf{1}^{VII}$. The plug-in connector 1, 1', 1", 1''', $\mathbf{1}^{IV}$, $\mathbf{1}^{V}$, $\mathbf{1}^{VI}$, $\mathbf{1}^{VII}$ is however not limited to these components. Different embodies of such a plug-in connector 1, 1', 1", 1''', $\mathbf{1}^{IV}$, $\mathbf{1}^{V}$, $1^{VI}$, $1^{VII}$ are illustrated in the following figures. The plug-in connector 1, 1', 1", 1'", $1^{IV}$, $1^{V}$, $1^{VI}$, $1^{VII}$ is constructed in a particularly simple manner and consequently can be assembled quickly. In addition, the plug-in connector 1, 1', 1", 1'", $1^{IV}$, $1^{V}$, $1^{VI}$, $1^{VII}$ is embodied in a very robust manner and is suitable for use in an industrial environment, in particular in harsh industrial environments.

FIG. 1 illustrates an exploded drawing of a plug-in connector 1. The plug-in connector 1 comprises an insulating body 2, an attachment casing 3, 3' and one or multiple contact elements 4. As is apparent in FIG. 1, the attachment casing 3, 3' can be embodied straight (FIG. 1, top left) or be bent by approx. 90° (FIG. 1, bottom left). The attachment casing 3, 3' has cut-outs (not illustrated) that for fixing purposes engage over latching webs 30 that are provided for this purpose and are formed as one on the insulating body 2, 2'. This fixing arrangement functions in a similar manner to the strain relief element 28, which is described below, and emphasizes the modularity of the plug-in connector. A cylindrical bearing receptacle 5 is formed as one in each case on two side faces of the insulating body 2. A prism-shaped contour 9 is formed as one directly on the bearing receptacle 5 and the function of this prism-shaped contour is described in more detail below.

The plug-in connector 1' or the mating plug-in connector 1' (terms are used synonymously) has optionally a cable casing 13 for fixing and providing strain relief of a connected cable (not illustrated). For this purpose, the cable casing 13 is equipped with a cable screw arrangement 14 and an associated seal 15. The media tightness of the plug-in connector 1' is increased by means of the cable casing 13.

The plug-in connector 1 can be equipped optionally with a locking bracket 6. The locking bracket 6 is embodied from sheet metal which has been processed in a bending and stamping process. The locking bracket 6 has essentially a U-shaped basic shape. Bearing receptacles 7 are provided in the side faces of the locking bracket 6 and the bearing receptacles engage over the bearing pins 5 of the insulating body 2. As a consequence, the locking bracket 6 is pivotably mounted on the insulating body 2. Bearing pins 5 are likewise formed as one on a mating plug-in connector 1'. In the locked state, the locking bracket 6 engages over the bearing pin 5 of the mating plug-in connector 1'. As a consequence, the plug-in connector 1 and the mating plug-in connector 1' are reversibly locked to one another.

A prism-shaped contour 9 is also likewise formed as one in each case on the bearing pins 5 of the mating plug-in connector 1'. The bearing pins 5 are embodied longer than the respective contour 9. This means that the bearing pins 5 protrude in a perpendicular manner further from the insulating body 2,2' than the respective contour 9.

The locking bracket 6 has in the region of its bearing receptacles 7 in each case an inwardly facing elevation 8. With the aid of the elevations 8 and the contours 9 that are formed as one on the bearing pins 5, the locking apparatus 6 is elastically widened during the locking procedure. The locking apparatus 6 does not rub with its side parts against the insulating body 2, 2' or against its side faces.

By virtue of the shape of the contours 9 and the associated elevations 8, the locking bracket 6 is held in its position in the closed state. It is necessary during the unlocking procedure to overcome a resistance since the locking bracket 6 is elastically widened again. As a consequence, an unintentional opening of the system or of the plug-in connection comprising a plug-in connector 1 and a mating plug-in connector 1' is prevented. Moreover, the locking bracket 6 does not rub with its side parts against the insulating body 2, 2' either against the insulating body 2 to which the locking bracket 6 is pivotably attached or against the insulating body 2' of the mating plug-in connector 1' that is to be connected.

Figure 14:
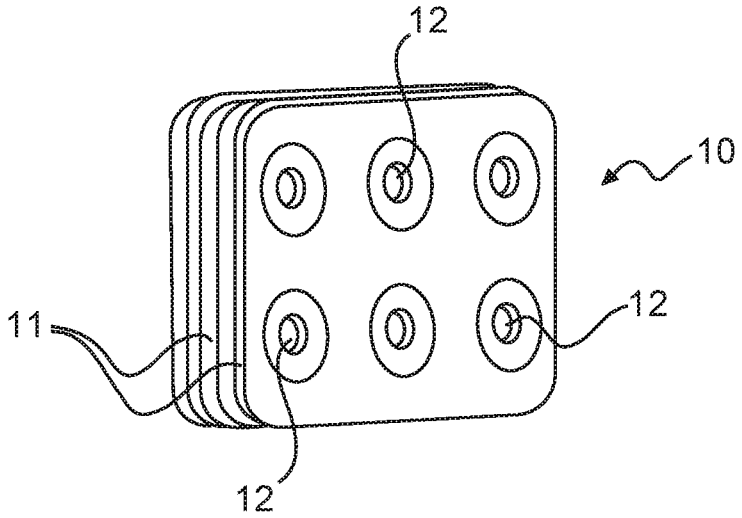
FIG. 14 illustrates a perspective view of a seal having multiple through-going openings.

The plug-in connector 1, 1' has a seal 10. The seal 10 is illustrated in an enlarged view in FIG. 14. The seal 10 has essentially a rectangular cross-section, wherein the corners or corner regions are rounded. The seal 10 has a lamellar structure 11 on the narrow sides. The seal 10 has six through-going openings 12. The through-going openings encompass in each case a conductor (not illustrated) that is attached to and in electrical contact with an associated contact element 4; 4'. As a consequence, the media tightness of the plug-in connector 1, 1' is significantly increased. The number of the through-going openings 12 corresponds to the number of contact elements 4, 4' that are arranged in the plug-in connector 1, 1'.

Figure 3:
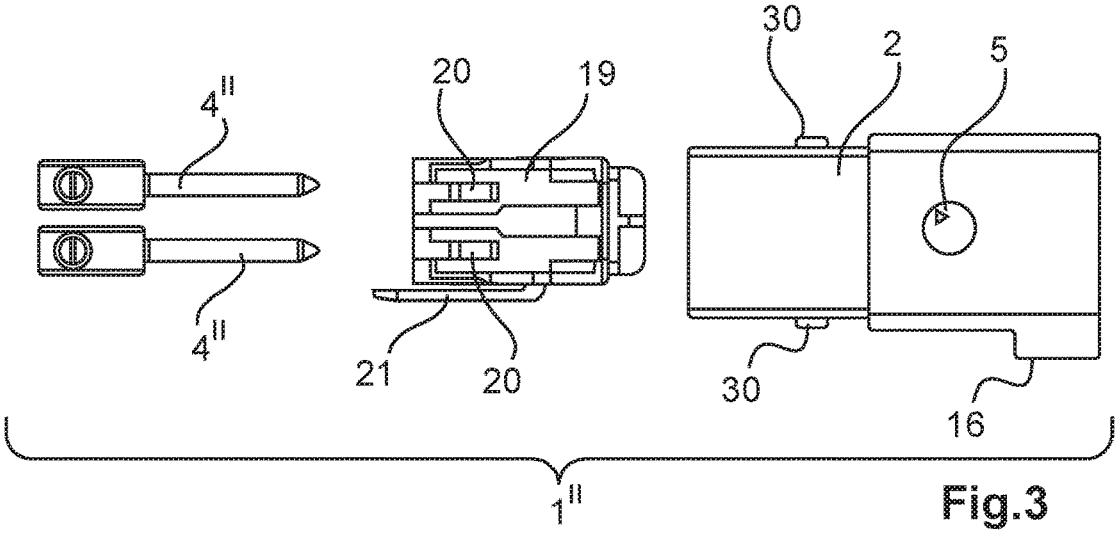
FIG. 3 illustrates an exploded drawing of a further plug-in connector.
Figure 4:
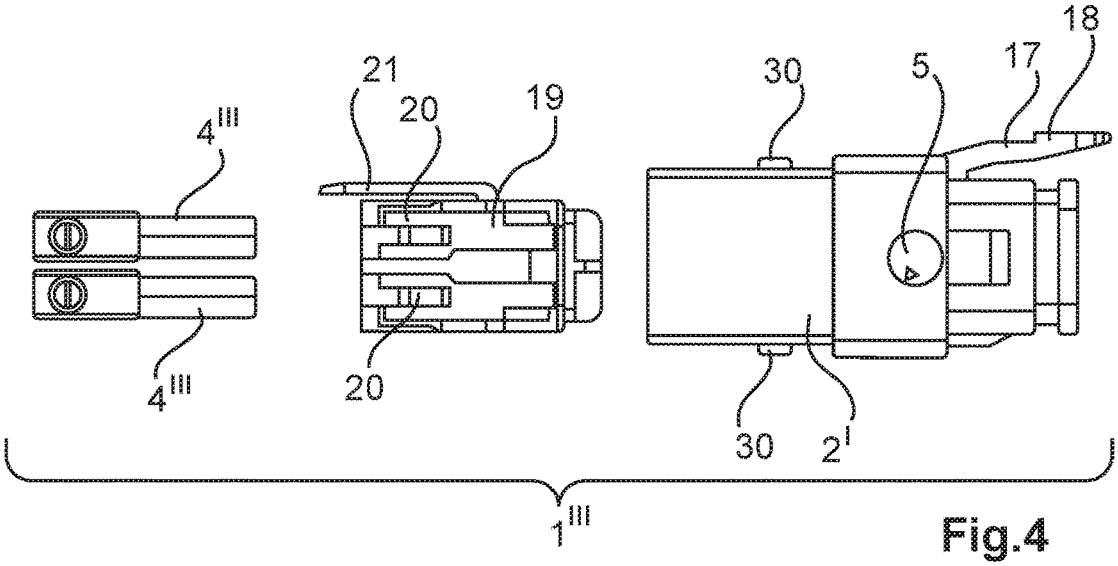
FIG. 4 illustrates an exploded drawing of a further plug-in connector.

FIGS. 3 and 4 illustrate an alternative (second) embodiment of a plug-in connector 1", 1'". The insulating body 2, 2' is essentially identical to the previous embodiments. The insulating body 2 of the plug-in connector 1" has an attachment tab 16. The insulating body 2' of the mating plug-in connector 1'" has an attachment tongue 17 that corresponds thereto and has a latching hook 18. The insulating body 2, 2' is manufactured from synthetic material. The attachment tongue 17 that is formed as one on the insulating body 2' of the mating plug-in connector 1', 1'" is embodied in an elastic manner. During the plugging-in procedure, the attachment tongue 17 of the mating plug-in connector 1'" engages in the attachment tab 16 of the plug-in connector 1" and the latching hook 18 engages in an undercut (not illustrated for reasons of overview) of the attachment tab 16. As a consequence, the plug-in connector 1, 1" and the mating plug-in connector 1', 1'" are reversibly locked to one another. It is also possible to provide insulating bodies without these latching means formed as one thereon, which are then limited to the above described latching bracket 6.

The second embodiment of the plug-in connector 1", 1'" has a contact carrier 19. The contact carrier 19 has receptacles 20 in which in each case a contact element 4", 4'" is arranged. The contact carrier 19 is latched in the insulating body 2, 2' of the plug-in connector 1", 1'". Finally, the contact elements 4", 4'" are then also attached in the insulating body 2, 2' of the plug-in connector 1", 1'" by way of the contact carrier 19. The contact elements 4", 4'" have on the connection side a screw connection. The strands of a connected conductor (not illustrated) are attached in a connection-side receiving sleeve by way of a lateral screw. The screw connection technology ensures that the plug-in connector 1, 1', 1", 1'", $1^{IV}$, $1^{V}$, $1^{VI}$ can be assembled in a simply manner. Contact elements 4", 4'" of this type are used in particular for transferring high currents.

Figure 5:
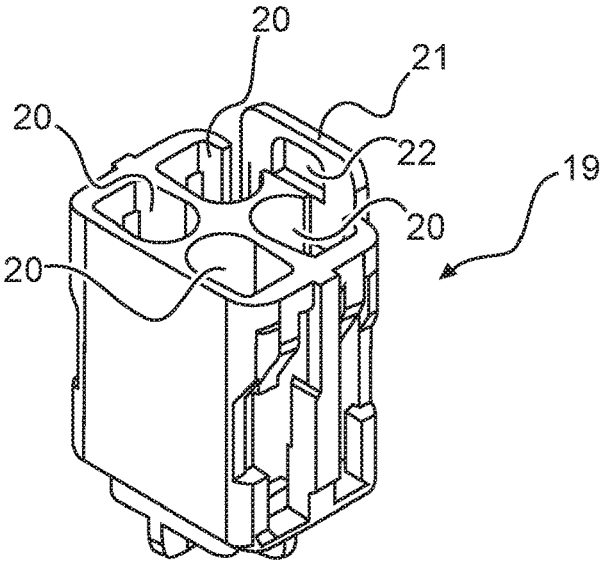
FIG. 5 illustrates a perspective view of a contact carrier.

FIG. 5 illustrates a perspective view of the said contact carrier 19. So as to fix the contact carrier 19 in the insulating body 2, 2', an attachment tab 21 is formed as one on the contact carrier 19 and the attachment tab 21 has a cut-out 22 in the interior of the insulating body 2, 2' and the cut-out 22 engages over a corresponding shaping (not illustrated for the sake of overview). The contact carrier 19 forms in the insulating body 2 the so-called plug-in region, insofar as this is equipped with pin contacts 4". The contact elements 4", 4'" are merely encompassed and held by the contact carrier 19. The insulating body 2 does not support this function. As a consequence, the plug-in connector 1", 1'" can be constructed in a more compact manner.

Figure 6:
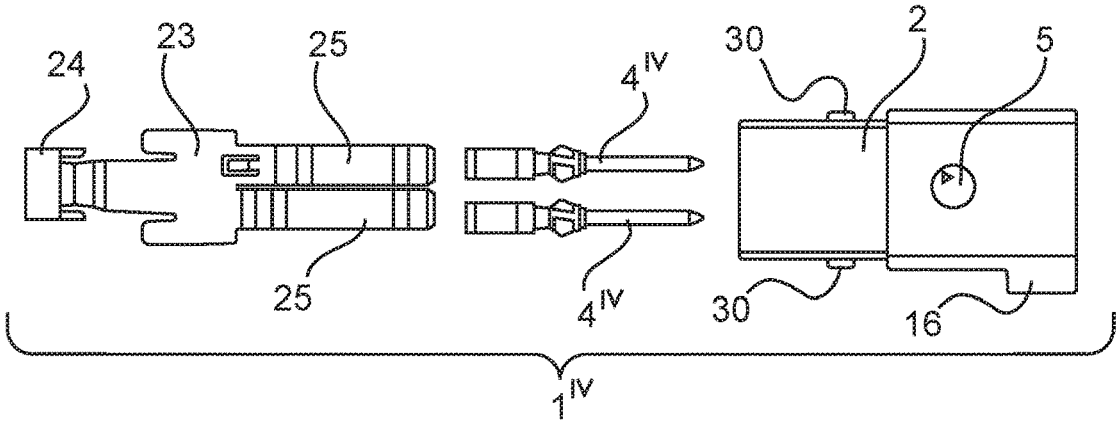
FIG. 6 illustrates an exploded drawing of a further plug-in connector.
Figure 7:
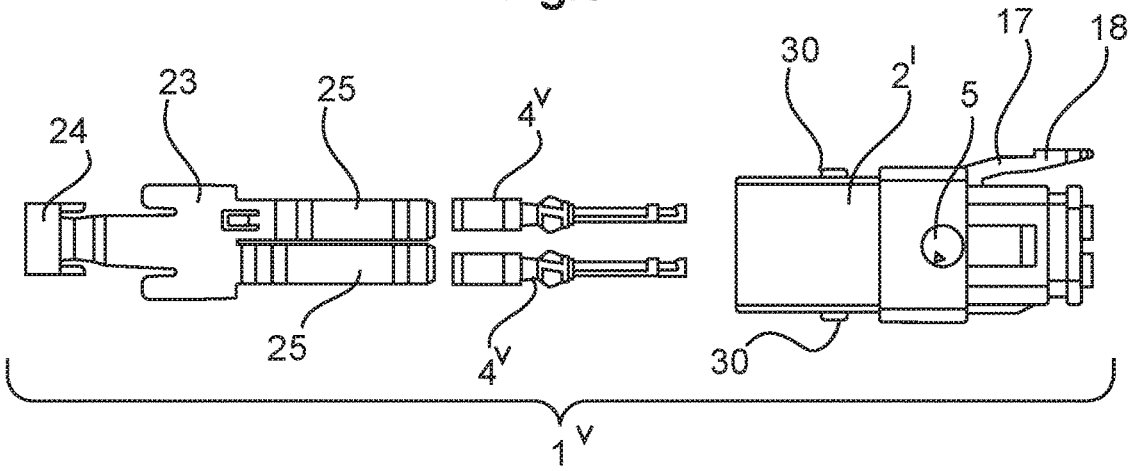
FIG. 7 illustrates an exploded drawing of a further plug-in connector.

FIGS. 6 and 7 illustrate an alternative (third) embodiment of a plug-in connector $1^{IV}$, $1^{V}$. The plug-in connector $1^{IV}$, $1^{V}$ comprises contact elements $4^{IV}$, $4^{V}$ that can be fixed or are fixed directly in the insulating body 2, 2'. The plug-in connector $\mathbf{1}^{IV}$, $\mathbf{1}^{V}$ has a shielding metal plate 23 that is arranged in the insulating body. The shielding metal plate 23 has on the connection-side a U-shaped shielding braid receptacle 24 that can be electrically conductively connected to a shielding braid of a connected cable (not illustrated). In this case, the shielding braid receptacle 24 is pushed around the stripped shielding braid of a connected cable and as a consequence is electrically connected to the shielding metal plate 23. This connection can be supported by means of a cable tie.

Figure 8:
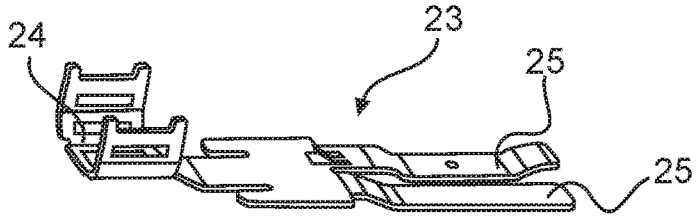
FIG. 8 illustrates a perspective view of a shielding element.
Figure 9:
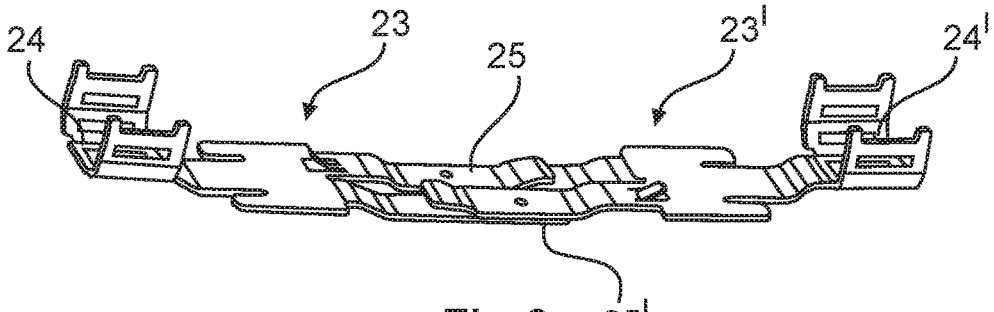
FIG. 9 illustrates a perspective view of two shielding elements that are plugged together.

FIG. 8 illustrates the shielding metal plate 23 separately. The shielding metal plate 23 is embodied from a metal plate and has been produced in a bending and stamping process. The shielding metal plate 23 has on the plug-in side two tabs 25 that face in the plug-in direction and are arranged offset with respect to one another. As the plug-in connector $\mathbf{1}^{IV}$ and the mating plug-in connector $\mathbf{1}^{V}$ are plugged together, the tabs 25, 25' of the respective shielding metal plates 23 engage in one another, as is apparent in FIG. 9. As a consequence, the shielding braids of the cable that is connected to the plug-in connector $\mathbf{1}^{IV}$ and the mating plug-in connector $\mathbf{1}^{V}$ are brought to the same electrical potential.

Figure 10:
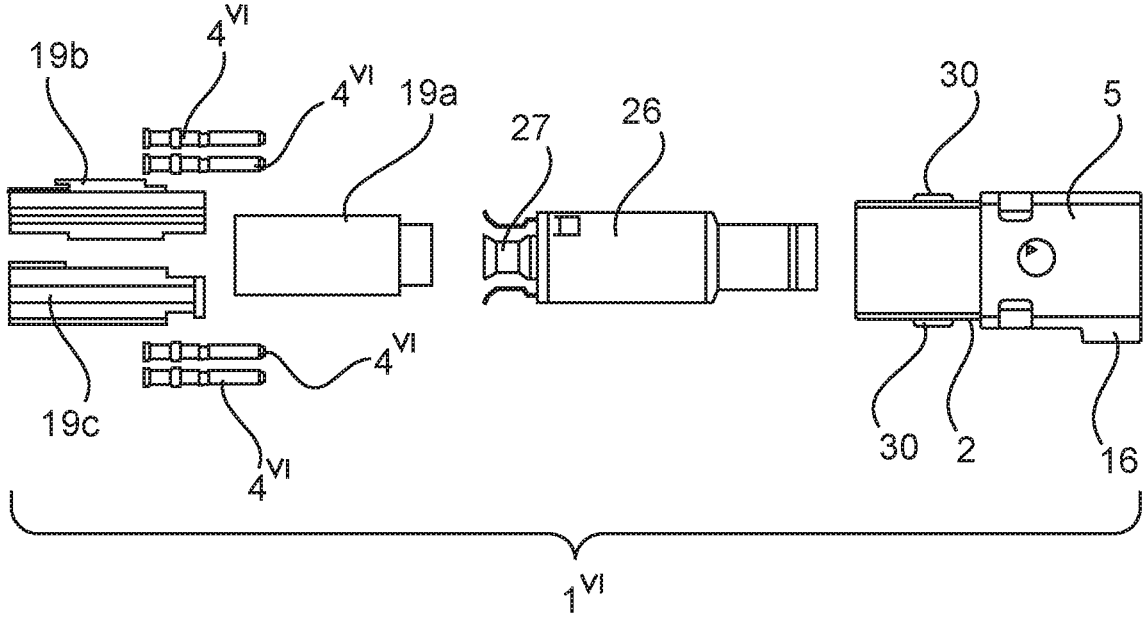
FIG. 10 illustrates an exploded drawing of a further plug-in connector.
Figure 11:
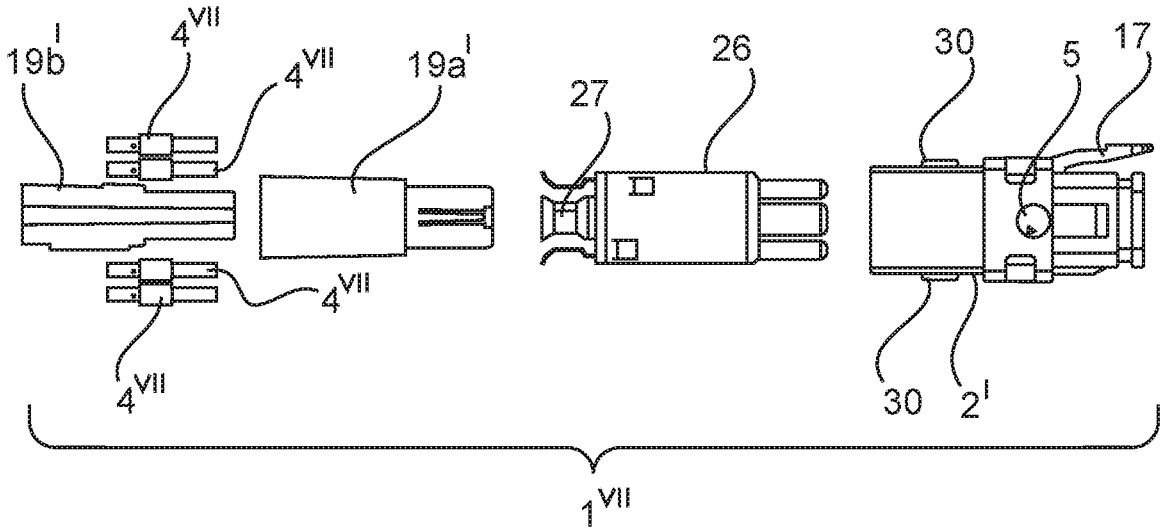
FIG. 11 illustrates an exploded drawing of a further plug-in connector.

FIGS. 10 and 11 illustrate an alternative (fourth) embodiment of a plug-in connector $\mathbf{1}^{VI}$, $\mathbf{1}^{VII}$ The plug-in connector $\mathbf{1}^{VI}$, $\mathbf{1}^{VII}$ comprises contact elements $\mathbf{4}^{VI}$, $\mathbf{4}^{VII}$. The contact elements $\mathbf{4}^{VI}$, $\mathbf{4}^{VII}$ are held in the insulating body 2, 2' by way of a two-part contact carrier 19'*a*, 19'*b* or by way of a three-part contact carrier 19*a*, 19*b*, 19*c*. The contact elements $\mathbf{4}^{V}$, $\mathbf{4}^{VII}$ are configured for transferring large quantities of data or signals in a high frequency range. The plug-in connector $\mathbf{1}^{VI}$, $\mathbf{1}^{VII}$ has a shielding sleeve 26 so as to electromagnetically shield the contact elements $\mathbf{4}^{VI}$, $\mathbf{4}^{VII}$ and the shielding sleeve 26 is arranged within the insulating body 2, 2'. The shielding sleeve 26 is formed from an electrically conductive material and has on the connection side contact arms 27 that can be electrically conductively connected to the shielding braid of a connected cable (not illustrated). This connection can be supported by means of a cable tie. The shielding sleeve 26 provides the plug-in connector $\mathbf{1}^{VI}$, $\mathbf{1}^{VII}$ with particularly high signal integrity.

Figure 12:
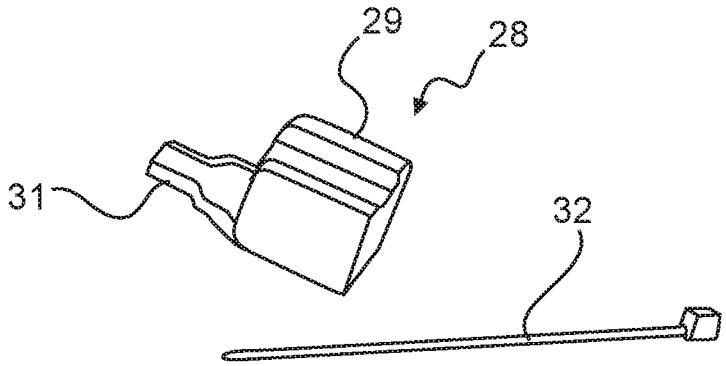
FIG. 12 illustrates a perspective view of a strain relief element.

FIG. 12 illustrates a strain relief element 28 that is already mentioned above. The strain relief element 28 is provided so as to so as to provide strain relief for multiple conductors (not illustrated) or for a connected cable (not illustrated). The strain relief element 28 has a rectangular cross-section and can be plugged on the connection side onto the insulating body 2, 2' and in so doing can be attached in a latching manner. In this case, the strain relief element 28 has cut-outs 29 that engage over latching webs 30 that are provided for this purpose and are formed as one on the insulating body 2, 2'. The strain relief element 28 comprises on the connection side a supporting web 31. The individual, connected conductors or the cable sheath of the connected cable can be placed on the supporting web 31. The conductors or the cable can be subsequently fixed to the supporting web 31 with the aid of a cable tie 32. A very cost-effective but yet extremely effective strain relief for the conductors and/or the cable is hereby provided.

Figure 13:
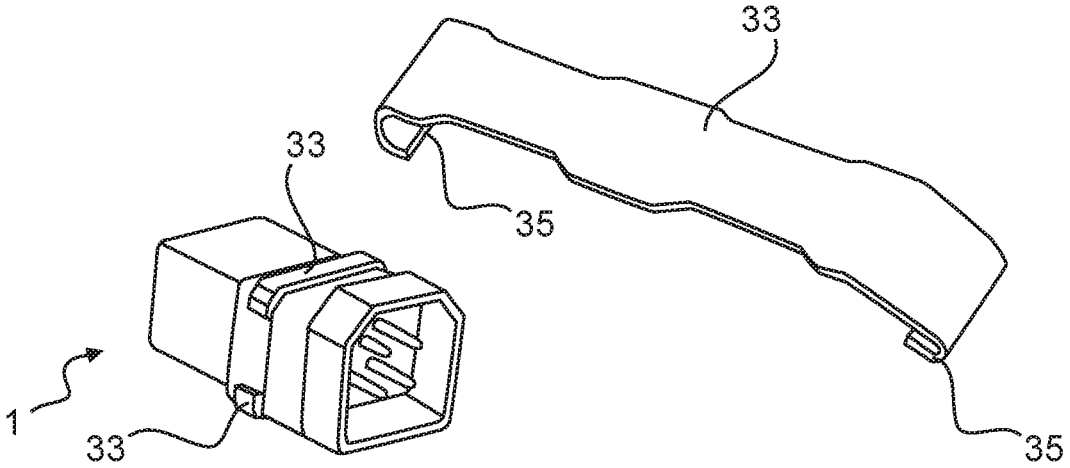
FIG. 13 illustrates a perspective view of a plug-in connector having an identifying element.

The plug-in connector 1 can be equipped with an identifying element 33, as is illustrated in FIG. 13. So as to fix the identifying elements 33 on the insulating body 2, 2', the identifying element 33 has at each end a gripping hook 35 that respectively engage with a cut-out 34 on both sides in the insulating body 2, 2'. The identifying element 33 has a color that is different from the insulating body 2, 2', in particular a signal color such as yellow or red or a combination of different signal colors. The identifying element 33 can be used for example so that multiple identical plug-in connectors 1, 1', 1", 1'", $\mathbf{1}^{IV}$, $\mathbf{1}^{V}$, $\mathbf{1}^{VI}$, $\mathbf{1}^{VII}$ on an electrical device can be distinguished from one another.

Figure 15:
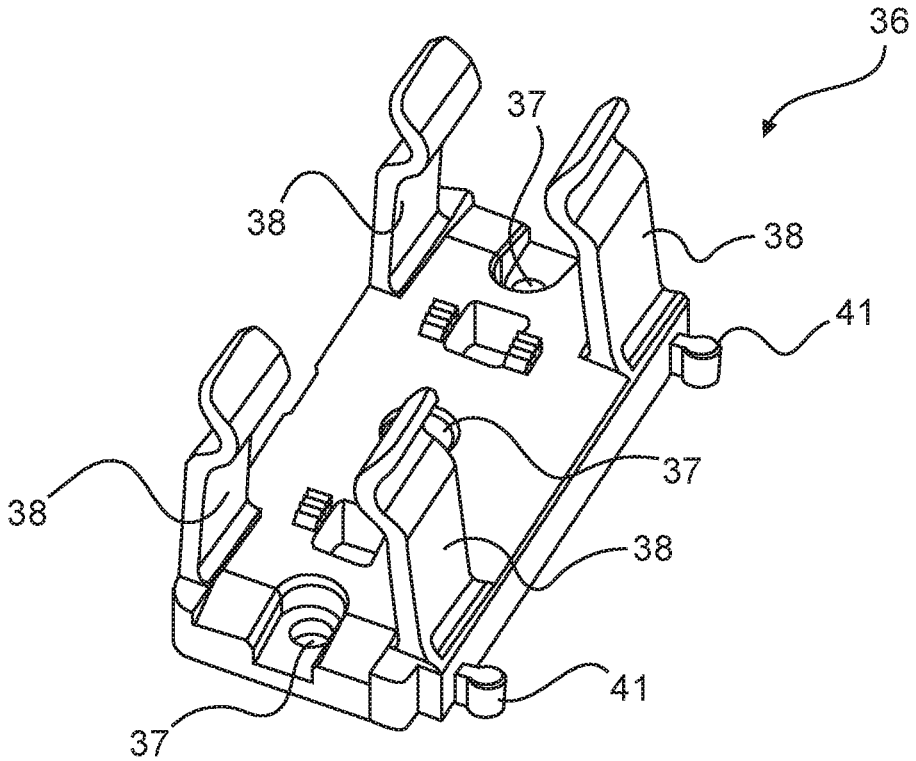
FIG. 15 illustrates a perspective view of a wall mounting for a plug-in connector.

FIG. 15 illustrates a perspective illustration of a wall mounting 36. The wall mounting 36 can be attached for example to a device wall. For this purpose, the wall mountings has openings 37 into which screws (not illustrated) can engage so as to produce the attaching arrangement. The wall mounting 36 has a rectangular, flat basic shape. S-shaped fixing arms 38 protrude in a perpendicular manner from the corner regions of the basic form. A plug-in connector (1, 1', 1", 1'", $\mathbf{1}^{IV}$, $\mathbf{1}^{V}$, $\mathbf{1}^{VI}$, $\mathbf{1}^{VII}$) can be reversibly fixed to the wall mounting 36 with the aid of the fixing arms 38. The plug-in connector (1, 1', 1", 1'", $\mathbf{1}^{IV}$, $\mathbf{1}^{V}$, $\mathbf{1}^{VI}$, $\mathbf{1}^{VII}$) can be fixed for example to a device wall by way of the wall mounting 36. Multiple wall mountings 36 can be arranged in a row over lateral contours 41. As a consequence, it is possible to provide in particular clear device installations.

Figure 16:
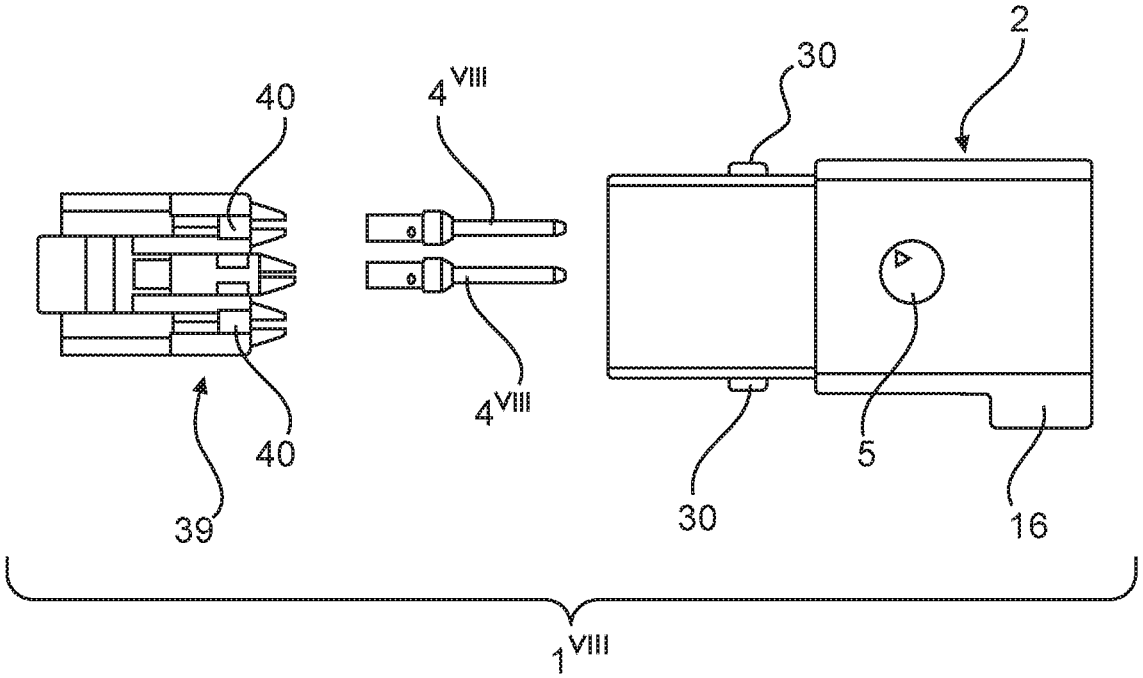
FIG. 16 illustrates an exploded view of a further plug-in connector.

FIG. 16 illustrates an alternative (fifth) embodiment of a plug-in connector $\mathbf{1}^{VIII}$. The insulating body 2, 2' is essentially identical to the previous embodiments. The fifth embodiment of the plug-in connector $\mathbf{1}^{VIII}$ has a holding plate 39. The holding plate 39 has receptacles 40 in which in each case a contact element $\mathbf{4}^{VIII}$ is arranged. The holding plate 39 is latched in the insulating body 2, 2' of the plug-in connector 1", 1'". Finally, the contact elements $\mathbf{4}^{VIII}$ are then also attached in the insulating body 2, 2' of the plug-in connector 1", 1'" by way of the holding plate 39. The contact elements $\mathbf{4}^{VIII}$ have on the connection side a crimp connection. In contrast to the embodiment variant having the contact carrier (FIGS. 3 and 4), the holding plate 39 does not form the plug-in region of the plug-in connector $\mathbf{1}^{VIII}$.

Even if different aspects or features of the invention are illustrated in the figures in each case in combination, it is obvious to the person skilled in the art—unless otherwise indicated—that the illustrated and discussed combinations are not the only possible combinations. In particular, units or feature complexes of different exemplary embodiments that correspond to one another may be exchanged with one another.

LIST OF REFERENCE NUMERALS

1 Plug-in connector
2 Insulating body
3 Attachment casing
4 Contact element
5 Bearing pin
6 Locking bracket
7 Bearing receptacle
8 Elevation
9 Contour
10 Seal
11 Lamellar structure
12 Through-going openings
13 Cable casing
14 Cable screw arrangement
15 Seal
16 Attachment tab
17 Attachment tongue
18 Latching hook
19 Contact carrier
20 Receptacle
21 Attachment tab
22 Cut-out
23 Shielding metal plate

24 Shielding braid receptacle
25 Tab
26 Shielding sleeve
27 Contact arms
28 Strain relief element
29 Cut-out
30 Latching webs
31 Supporting web
32 Cable tie
33 Identifying element
34 Cut-out
35 Latching hook
36 Wall mounting
37 Openings
38 Fixing arms
39 Holding plate
40 Receptacle
41 Contours

The invention claimed is:

1. A modular plug-in connector system, comprising:
an insulating body;
at least one contact element that is held in the insulating body; and
a plurality of casings, including
an attachment casing for attaching an electrical device,
a strain relief element for strain relief of multiple conductors or of a connected cable, and
a cable casing for fixing and providing strain relief of a connected cable,
wherein the insulating body simultaneously forms a plug-in connector casing of a plug-in connector, and
wherein the insulating body comprises latching webs for fixing the insulating body to one casing selected from the plurality of casings.

2. The modular plug-in connector system as claimed in claim 1,
wherein the insulating body has an attachment tab or an attachment tongue for reversibly attaching to a mating plug-in connector.

3. The plug-in connector system as claimed in claim 1,
wherein the insulating body has a rectangular cross-section, and
wherein the latching webs are formed on a connection-side of the insulating body, and
wherein each of the plurality of casings comprises cut-outs configured to engage over the latching webs.

4. The modular plug-in connector system as claimed in claim 1,
wherein the attachment casing for attaching an electrical device is straight, and
wherein the plurality of casings comprises
a further attachment casing that is bent.

5. The modular plug-in connector system according to claim 1,
wherein the plug-in connector has a seal that in turn has through-going openings for the at least one contact element and/or conductors that are connected thereto, and
wherein a number of through-going openings corresponds to a number of contact elements of the at least one contact element, and
wherein the seal has a rectangular cross-section with rounded corners, and
wherein the seal has a lamellar structure along narrow sides around the rectangular cross section.

6. The modular plug-in connector system as claimed in claim 1,
wherein the at least one contact element is elongated along an axis and has a crimp connection for electrically contacting a conductor on one end, and
wherein the plug-in connector system comprises at least one further contact element that is elongated along an axis and has a screw connection for electrically contacting a conductor.

7. The modular plug-in connector system as claimed in claim 1,
wherein the plug-in connector has an identifying element that has a color that is different from the insulating body and wherein the identifying element can be reversibly fixed to the insulating body.

8. The modular plug-in connector system as claimed in claim 1,
wherein a bearing pin is formed as one in each case on two opposite-lying side faces of the insulating body and a locking bracket having a U-shaped cross-section is pivotably mounted on the bearing pin.

9. The modular plug-in connector system according to claim 8,
wherein the locking bracket has in a region of a respective bearing receptacle an elevation that faces the insulating body.

10. The modular plug-in connector system according to claim 8,
wherein the bearing pins each have a cylindrical basic shape with a prism-shaped contour formed thereon.

11. The modular plug-in connector system according to claim 10,
wherein the prism-shaped contour has a triangular cross-section.

12. The modular plug-in connector system as claimed in claim 1,
wherein the plug-in connector has a contact carrier, in which the at least one contact element is arranged and wherein the contact carrier is configured to be latched in the insulating body.

13. The modular plug-in connector system according to claim 12,
wherein the contact carrier forms a plug-in region of the plug-in connector.

14. The modular plug-in connector system as claimed in claim 1,
wherein the plug-in connector has a shielding metal plate that can be electrically conductively connected on a connection side to a shield braid of a connected cable.

15. The modular plug-in connector system according to claim 14,
wherein the shielding metal plate has on a plug-in side two tabs that face in the plug-in direction and are arranged offset with respect to one another.

16. The modular plug connector system as claimed in claim 14,
wherein the shielding metal plate has on the connection side a shielding braid receptacle.

17. The modular plug-in connector system as claimed in claim 1,
wherein so as to provide electromagnetic shielding the plug-in connector has a shielding sleeve that is arranged within the insulating body.

18. The modular plug-in connector system according to claim 17,
wherein the shielding sleeve has contact arms for contacting the shielding braid of a connected cable.

* * * * *